US006546940B1

(12) United States Patent
Rouillard et al.

(10) Patent No.: US 6,546,940 B1
(45) Date of Patent: Apr. 15, 2003

(54) CLEANING COMPOSITION AND METHOD FOR USING THE SAME

(75) Inventors: Carol Anne Rouillard, Loveland, OH (US); Charles Allen Crawford, Lebanon, OH (US); Jim Joseph Hilarides, Lebanon, OH (US); Holger Theyssen, Freinsheim (DE); Roland Schording, Diltheystr (DE); Stefan Grober, Frankensthal (DE)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 09/950,198

(22) Filed: Sep. 10, 2001

(51) Int. Cl.[7] ..... B08B 3/04

(52) U.S. Cl. ..... 134/22.12; 134/22.18; 134/26; 134/41; 134/42; 510/218; 510/219; 510/477; 510/488; 510/499

(58) Field of Search ..... 510/218, 219, 510/477, 488, 499; 134/41, 42, 22.12, 22.18, 26

(56) References Cited

U.S. PATENT DOCUMENTS

| | | | | |
|---|---|---|---|---|
| 5,064,561 | A | | 11/1991 | Rouillard |
| 5,888,311 | A | | 3/1999 | Laufenberg et al. |
| 5,891,260 | A | * | 4/1999 | Streets et al. ..... 134/8 |
| 6,103,686 | A | * | 8/2000 | Asakawa et al. ..... 510/479 |
| 6,184,340 | B1 | | 2/2001 | Smith et al. |

FOREIGN PATENT DOCUMENTS

| | | |
|---|---|---|
| WO | 97/21797 | 6/1997 |

* cited by examiner

*Primary Examiner*—Gregory Delcotto
(74) *Attorney, Agent, or Firm*—Renee J. Rymarz; Warren R. Bovee; Neil E. Hamilton

(57) ABSTRACT

A composition for a removing soil is described. The composition has a carboxylated imino compound and optionally an oxidizing agent. The composition displays excellent cleaning properties on processing equipment such as the equipment found in breweries, dairy plants and carbonated beverage plants. The composition also displays excellent lipid-based and protein-based soil removal.

3 Claims, No Drawings

CLEANING COMPOSITION AND METHOD FOR USING THE SAME

FIELD OF THE INVENTION

The present invention is directed to a cleaning composition. Particularly, the invention is directed to a composition that comprises a chelating agent whereby the composition unexpectedly displays superior cleaning results even when the chelating agent is substantially biodegradable. Such a cleaning composition may further comprise an oxidizing agent, especially when it is desired to clean equipment contaminated with thermally degraded soil.

BACKGROUND OF THE INVENTION

It is extremely important, for example, to clean food and beverage processing facilities like breweries, carbonated beverage plants, and especially, dairy plants. Typically, such processing facilities are cleaned by subjecting the internal and/or external portions of the machines that make up the facilities to a solution that reacts with the various soils present within the machines. Also, it is often very desirable to clean the processing facilities (i.e., plants) themselves with open plant cleaning equipment and technologies.

A cleaning-in-place (CIP) system, for example, is a cleaning system which is often preferred when cleaning, disinfecting and sanitizing equipment employed in processing facilities. Such a CIP system typically comprises several storage containers that independently house solutions, like a pre-rinse solution, cleaning solution and a post-rinse solution. Often, these types of solutions are pre-pumped into the gas and liquid passages of the machines being cleaned and then are circulated through the machines until they are finally discharged to waste or recovered for subsequent cleaning cycles.

Conventional CIP compositions typically comprise chelators like EDTA. EDTA, however, is not readily biodegradable and thereby is known to cause a release of heavy metals when discharged into the environment, particularly streams. Other CIP compositions utilize methylglycine diacetic acid (MGDA) in lieu of EDTA. MGDA is more biodegradable than EDTA; however, CIP compositions comprising MGDA do not display favorable cleaning results in environments having thermally degraded lipid- and/or protein-comprising soils.

It is of increasing interests to prepare a composition that comprises environmentally friendly additives and is effective at cleaning soils like those found in processing facilities. This invention, therefore, is directed to a composition for removing soil wherein the composition comprises a chelating agent, and optionally, an oxidizing agent, and the composition is environmentally friendly and unexpectedly displays superior cleaning results, including lipid-comprising soil removal, or protein-comprising soil removal, or both.

ADDITIONAL INFORMATION

Efforts have been disclosed for cleaning processing equipment. In U.S. Pat. No. 5,888,311, a process for cleaning equipment in the absence of a pre-rinse step is described.

Other efforts have been disclosed for cleaning equipment. In World Patent Application WO 97/21797, a cleaning-in-place composition with methylglycine diacetic acid is disclosed.

Still other efforts have been disclosed for cleaning equipment. In U.S. Pat. No. 5,064,561, a CIP system with an alkaline material and an enzyme is described.

SUMMARY OF THE INVENTION

In a first embodiment, the present invention is directed to a composition for removing soil from a hard surface, the composition comprising:

(a) a carboxylated imino compound; and (b) water wherein (i) the composition is not used in a dishwasher; and (ii) the soil is soil generated at a food, beverage or dairy processing facility, and not soil recovered from a petroleum processing facility.

In a second embodiment, the present invention is directed to a composition for removing soil from a hard surface, the composition comprising:

(a) a carboxylated imino compound;

(b) water; and (c) an oxidizing agent.

In a third embodiment, the present invention is directed to a method for using the composition of the first or second embodiment of this invention.

In a fourth embodiment the present invention is directed to a kit comprising:

(a) a first composition comprising a carboxylated imino compound;

(b) a second composition comprising an oxidizing agent; and (c) instructions to utilize component (a) and (b) on thermally degraded soil, especially thermally degraded soil comprising thermally degraded protein-comprising soil, thermally degraded lipid-comprising soil, milkstone or combinations thereof.

As used herein, Portion I of the composition for removing soil is defined to mean a portion or first composition not comprising oxidizing agent, and Portion II of the composition for removing soil is defined to mean a portion or second composition not comprising carboxylated imino compound. Composition for removing soil is defined to mean a composition comprising carboxylated imino compound and water, including a composition comprising Portion I, or a composition comprising a mixture of Portion I and Portion II.

DETAILED DESCRIPTION OF THE PREFERRED EMBODIMENTS

The only limitations with respect to the carboxylated imino compound that may be used in this invention is that the carboxylated imino compound can aid in the removal of lipid- and/or protein-comprising soils in food and beverage processing facilities.

Often, the carboxylated imino compound which may be used in this invention has the general formula:

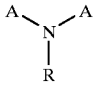

wherein each A is independently a diacid group like an oxalic, malonic, succinic, glutaric, adipic or pimelic acid group, and R is hydrogen, a $C_{1-6}$ alkyl or aryl. In a preferred embodiment, however, each A is a succinic acid group and R is hydrogen.

The carboxylated imino compounds employable in the present invention may be made, for example, by treating an anhydride with water (e.g., to produce the diacid) and subjecting the resulting diacid to ammonia and sodium hydroxide to produce the desired carboxylated imino compound. Also, it is noted herein that it is within the scope of this invention to employ salts of carboxylated imino compounds.

In a most preferred embodiment, the carboxylated imino compound used in this invention is a salt and made with maleic anhydride as the precursor. Such a preferred compound is typically identified as D, L-aspartic acid, N-(1,2-dicarboxyethyl), tetrasodium salt, and sold under the name Baypure (iminodisuccinic acid sodium salt) by Bayer.

Regarding the amount of carboxylated imino compound that may be used in this invention, often from about 0.1% to about 60.0%, and preferably, from about 0.2% to about 30.0%, and most preferably, from about 20.0% to about 40.0% by weight of carboxylated imino compound is used, based on total weight of Portion I of the composition for removing soil, including all ranges subsumed therein. The balance of Portion I comprises water.

When it is desired to utilize an oxidizing agent (i.e., when a thermally degraded soil is targeted for removal), any oxidizing agent may be used as long as the agent enhances cleaning with the carboxylated imino compound. Such an oxidizing agent includes hydrogen peroxide, peroxyacids (like peracetic acid), ozone and chlorine dioxide. The amount of oxidizing agent used is often from about 0.01% to about 60.0%, and preferably, from about 0.05% to about 40.0%, and most preferably, from about 0.08% to about 30.0% by weight of oxidizing agent, base on total weight of Portion II of the composition for removing soil, including all range subsumed therein. The balance of Portion II is preferably water.

When preparing Portion I, or Portion II, or the composition for removing soil, each ingredient (component of the respective composition) may be added to a mixing vessel and stirred under conditions of moderate shear. There is no limitation with respect to the temperature and pressure at which the mixing occurs as long as the desired compositions may be made. Typically, however, the compositions are made at ambient temperature and at atmospheric pressure.

It is within the scope of this invention to utilize as the composition for removing soil only Portion I; therefore, the composition for removing soil will comprise a carboxylated imino compound and not an oxidizing agent. Such a composition for removing soil is generally preferred when the soil targeted for removal has not been thermally degraded. Thermally degrade soil, as used herein, is defined to mean soil that results from a process (e.g., a process involving food, beverages and dairy) that occurs at a temperature of greater than about 50° C., whereby soil that has not been thermally degraded results from a process that occurs at a temperature of less than about 50° C.

When it is desired to remove thermally degraded soil, however, it is generally preferred that the composition for removing soil comprises both Portion I and Portion II. Thus, when thermally degraded soil is being subjected to the composition for removing soil of this invention, such a composition preferably comprises a carboxylated imino compound as well as an oxidizing agent.

When Portion I and Portion II are employed to make the composition for removing soil of this invention, the resulting in use solution typically comprises from about 0.01% to about 20.0%, and preferably, from about 0.02% to about 10.0%, and most preferably, from about 1.0% to about 3.0% by weight Portion I, and from about 0.01% to about 10.0%, and preferably, from about 0.02% to about 5.0%, and most preferably, from about 0.1% to about 1.0% by weight Portion II.

Regarding optional additives that may be used in this invention, such optional additives include anti-foaming agents, hydrotropes, wetting agents, crystal growth inhibitors, stabilizers, enzymes and sources of alkali. Portion I and Portion II may comprise, independently, no more than about 60% by weight optional additives based on total weight of Portion I and Portion II, respectively.

The anti-foaming agents which may be used in this invention include well known agents like silica, silicones, aliphatic acids or esters, alcohols, alkoxylated fatty alcohols, and ethylene oxide-propylene oxide copolymers. The preferred anti-foaming agent used in the present invention is the linear alcohol sold under the name Plurafac, as made available by BASF. A more detailed description of the type of anti-foaming agents which may be used in this invention may be found in U.S. Pat. No. 6,184,340, the disclosure of which is incorporated herein by reference.

The hydrotropes which may be used in this invention include surfactants selected from lauryl sulfate, sodium xylene sulfonate, toluene sulfonic acid (and salts thereof), sulfosuccinate salts, sodium cumene sulfonate, phosphate esters, akylpolyglucosides, fatty acids and their salts, and the imidazolines.

Regarding the wetting agents which may be used in this invention, such wetting agents are commercially available and typically include low foaming nonionic surfactants like those comprising alkylpolyglucosides, or ethylene oxide moieties, or propylene oxide moieties as well as copolymers and mixtures prepared therefrom.

The crystal growth inhibitors which may be used in this invention include phosphonates like those sold commercially under the name Bayhibit (Bayer) and Dequest (Solutia, Inc.). Other crystal growth inhibitors include polycarboxylates such as those made available by Alco under the name Alcosperse. The stabilizers which may be used in this invention include phosphonates, including those sold commercially under the name Dequest by Solutia, Inc.

There is no limitation with respect to the enzymes which may be used in this invention other than that the enzymes may be formulated in the cleaning composition of the present invention. These types of enzymes include amylases, lipases, proteases, lactases and mixtures thereof. Such enzymes are well known and made commercially available from suppliers like Novo Nordisk A/S and Genencor.

The composition for removing soil of the present invention unexpectedly displays superior cleaning results when, for example, thermally degraded and/or non-thermally degraded lipid-comprising soil and protein-comprising soil is/are present. The composition for removing soil of the present invention also displays excellent cleaning properties when it is desired to remove contaminants or soils that may be classified as salts, like sodium carbonate or bicarbonate, calcium carbonate or calcium phosphate.

It is noted herein that the composition for removing soil of this invention unexpectedly displays cleaning properties when maintained in the pH range from about 10.0 to about 14.0. When superior cleaning properties are desired, the composition is preferably maintained at a pH from about 11.0 to about 13.5, and most preferably, from about 11.0 to about 12.5, including all ranges subsumed therein.

The pH of the composition for removing soil of the present invention may be modified by optionally adding acids, bases and/or employing buffers. Such acids include sulfuric and phosphoric acid. The bases include sodium, potassium and lithium hydroxide and the buffers include bicarbonate, carbonate and bicarbonate/carbonate buffers and borax. The amount of pH modifiers that may be used is limited only to the extent that the desired pH is obtained. As to the buffers, the amount added is enough to keep the composition of this invention substantially stable.

After the composition for removing soil of this invention is prepared, the pH of the composition may be modified or buffered in the tank generator it is prepared in. Optionally, a separate tank may be used to modify or buffer the composition.

Subsequent to pH modifying and/or buffering, the composition for removing soil of this invention is pumped, via a pump and feed line, to the processing equipment targeted for cleaning. Thus, the composition for removing soil of the present invention is preferably used in a CIP process. To extent possible, the composition is pumped through all internal portions of the equipment until it is finally discharged for recycling or waste. Moreover, the composition of this invention may be pumped or sprayed on to the external surface of the equipment targeted for cleaning or disinfecting. Such a composition may also be used for open plant cleaning. The pumping is achieved via any art recognized pump. Such pumps may generally be classified as peristaltic, diaphragm or positive displacement pumps. The pumps are typically manufactured by suppliers like Watson-Marlow, Inc. and Tri-Clover, Inc. The spraying devices which may be used, for example, to spray the external portion of the processing equipment are typically distributed through establishments like System Cleaners A/S. The pumps and spraying devices which may be used in this invention may also be purchased from sanitary and hygiene specialists like DiverseyLever. Moreover, it is within the scope of this invention to make and store the composition of this invention and use the composition as needed. It is also within the scope of this invention to make the composition and to then feed the composition directly to the pump responsible for delivering the composition. Still further, a combination of stored and newly made composition may be fed to the pump responsible for delivering the composition.

As to the conduit that may be employed in this invention, such conduit is limited only to the extent that it is capable of transporting the composition for removing soil of this invention. The conduit is often a polymeric conduit or metal conduit, with stainless steel being especially preferred. Also, such conduit has an inside diameter ranging from about 0.25 cm to about 20 cm, but preferably, is from about 2.5 cm to about 10 cm.

The rate at which the composition for removing soil is delivered to the processing equipment is limited only to the extent that the rate does not prevent the composition from cleaning the processing equipment targeted. Typically, however, the rate at which the composition is delivered to the processing equipment is one which is selected or derived by maintaining a minimum linear velocity from about 1.5 to about 2.5 meters/second. In a most preferred embodiment, Portion I and Portion II are delivered to the processing equipment independently, and Portion I is supplied in a manner to produce an in use solution having from about 10 to about 20,000 and preferably, from about 200 to about 10,000, and most preferably, from about 2000 to about to about 4000 ppm carboxylated imino compound, and Portion II is supplied in a manner to produce an in use solution having from about 10 to about 10,000, preferably, from about 20 to about 5000, and more preferably, from about 100 to about 2000, and most preferably, from about 500 to about 1500 ppm oxidizing agent.

The supplying of the composition for removing soil of this invention to processing equipment targeted for cleaning may be done in a manner such that the composition being fed is fed into a single feed line of the processing equipment. In a preferred embodiment, the composition is fed into a feed line of each component of the processing equipment. Moreover, the cleaning composition of the present invention may be mixed within or external to the processing equipment being cleaned.

It should be noted herein that the composition for removing soil of this invention comprises a carboxylated imino compound and optionally an oxidizing agent. It is, however, within the scope of this invention for the composition to consist essentially of a carboxylated imino compound, oxidizing agent and water. It is further within the scope of this invention for the composition to consist of carboxylated imino compound, an oxidizing agent and water. Moreover, when the composition for removing soil of this invention is pumped and/or sprayed, the composition may be subjected to pressure and heat. Pressure and heat (e.g., temperature of the composition) may vary and are only limited to the extent that the composition may be used to clean the processing equipment of concern.

The examples which follow are provided to further illustrate and facilitate an understanding of the present invention. Therefore, the examples are not meant to be limiting and modifications which fall within the scope and spirit of the claims are intended to be within the scope and spirit of the present invention.

EXAMPLES 1–2

| | weight % based on 100% active raw material | |
|---|---|---|
| Ingredient | Example 1 | Example 2 |
| Sodium hydroxide | 10.00% | 10.00% |
| Iminodisuccinate sodium salt | 15.30% | |
| MGDA | | 13.50% |
| phosphono ,1,2,4,butanetricarboxylic acid | 1.25% | 1.25% |
| amino tris (methylene phosphonic acid) | 1.25% | 1.25% |
| Alcohol alkoxylate (C13–C15) | 0.25% | 0.25% |
| Alcohol alkoxylate (C13–C15) | 0.50% | 0.50% |
| cumene sulphonic acid sodium salt | 2.80% | 3.15% |
| hydrogen peroxide | 8.75% | 8.75% |
| Water | Balance | Balance |

The compositions for removing soil or Examples 1 and 2 were prepared by mixing the ingredients under moderate shear in a mixing vessel. Portion I and Portion II (i.e., when a carboxylated imino compound and oxidizing agent were present) were simultaneously prepared in one vessel.

Soil removal data was generated using a laboratory test having a model lab heat exchanger soiled with thermally degraded milk, and the test was conducted in a manner similar to the one described in Delsing B.M.A., and Hiddinkj, Nederlands Instituut Voor Zuivelodersoek, Verslag V240, Fouling of Heat Transfer Surfaces by Dairy Liquids, Reprint From Netherlands Milk and Dairy Journal, 37 1983, pages 139–148. The data in the Table shows that the composition for removing soil of Example 1, which contained a carboxylated imino compound and an oxidizing agent, is superior to Example 2 which employed MGDA in lieu of carboxylated imino compound. Visual observations of cleanliness are set forth in the Table.

TABLE

| Visual Cleanliness | % Clean A |
|---|---|
| Example 1 | 100% |
| Example 2 | 10% |

A- percent clean means percent removal of thermally degraded protein-comprising soil based on visual analysis of the heat exchanger. Moreover, inductively coupled plasma emission spectroscopy of the waste streams generated in the Examples indicated that about 10% more calcium comprising soil was removed when the composition for removing soil of Example 1 was used.

EXAMPLES 3–5

| | weight % assuming 100% active raw materials | | |
|---|---|---|---|
| Ingredient | Example 3 | Example 4 | Example 5 |
| Water | Balance | Balance | Balance |
| potassium hydroxide | | 9.99% | |
| Iminodisuccinatye sodium salt | 15.30% | 10.20% | |
| MGDA | | | 13.50% |
| Phosphono 1,2,4, butanetricarboxylic acid | 1.25% | 1.25% | 1.25% |
| Amino tris (methylene phosphoric acid) | 1.25% | 1.25% | 1.25% |
| Alcohol alkoxylate (C13–C15) | 0.25% | 0.25% | 0.25% |
| Alcohol Alkoxylate (C13–C15) | 0.50% | 0.50% | 0.50% |
| Alkylaryl alkoxy phosphate ester potassium salt | | 0.25% | |
| alky polyglucoside | | 2.28% | |
| Cumene sulfonic acid sodium salt | 3.15% | | 3.15% |

The solutions of Examples 3 and 5 were used as an additive to 0.25% active sodium hydroxide and the solution of Examples 4 was used as defined. The compositions for removing soil of Examples 3–5 were used to clean stainless steel panels that were soaked in non-thermally degraded milk for about 10 minutes. The panels were subjected to the compositions for removing soil for about 10 minutes (in a manner similar to the one described in U.S. Pat. No. 5,064,561, column 8). Cleaning results, based on visual analysis, indicated that all panels were about 100% free of non-thermally degraded soil. The results indicate that the compositions for removing soil of the present invention can successfully remove non-thermally degraded soils.

What is claimed is:

1. A CIP method for removing soil from food processing equipment comprising the steps of:

(a) supplying a composition comprising a carboxylated imino compound

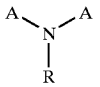

wherein each A is independently a diacid group selected from the group consisting of an oxalic, malonic, succinic, glutanic, adipic, and pimelic acid group and R is hydrogen, a $C_{1-16}$ alkyl, or an aryl group; and water;

(b) supplying an oxidizing agent at a rate to produce an in use cleaning solution comprising from about 20 to about 5000 ppm oxidizing agent; further, contacting said composition comprising the carboxylated imino compound and water and oxidizing agent with the food processing equipment.

2. The CIP method for removing soil according to claim 1 wherein carboxylated imino compound and oxidizing agent are simultaneously supplied to the food processing equipment.

3. The CIP method for removing soil according to claim 1 wherein the carboxylated imino compound and oxidizing agent are not simultaneously supplied to the food processing equipment.

* * * * *